United States Patent [19]

Chekroun

[11] 4,212,014

[45] Jul. 8, 1980

[54] ELECTRONICALLY CONTROLLED DIELECTRIC PANEL LENS

[75] Inventor: Claude Chekroun, Bures sur Yvette, France

[73] Assignee: Societe d'Etude du Radant, Orsay, France

[21] Appl. No.: 918,053

[22] Filed: Jun. 22, 1978

[30] Foreign Application Priority Data

Jun. 24, 1977 [FR] France ..... 77 19365

[51] Int. Cl.[2] ..... H01Q 19/06

[52] U.S. Cl. ..... 343/754; 343/909

[58] Field of Search ..... 343/754, 756, 854, 909, 343/910, 911 R, 911 L

[56] References Cited

U.S. PATENT DOCUMENTS

| | | | |
|---|---|---|---|
| 2,959,783 | 11/1960 | Iams | 343/754 |
| 3,213,454 | 10/1965 | Ringenbach | 343/771 |
| 3,276,023 | 9/1966 | Dorne et al. | 343/754 |
| 3,708,796 | 1/1973 | Gilbert | 343/754 |
| 3,961,333 | 6/1976 | Purinton | 343/909 |

FOREIGN PATENT DOCUMENTS

| | | | |
|---|---|---|---|
| 1329686 | 5/1962 | France | 343/754 |
| 2224887 | 10/1974 | France | 343/754 |

*Primary Examiner*—David K. Moore

*Attorney, Agent, or Firm*—Finnegan, Henderson, Farabow, Garrett & Dunner

[57] ABSTRACT

Bipolar switches in first conductive leads mounted in a dielectric panel are divided into successive groups of alternating polarity and additional pairs of leads are positioned in the panel adjacent each first lead to couple the groups of switches in each first lead in parallel. A reduced reversed biasing of the additional leads results in the first leads being selectively rendered discontinuous by the switches, changing the electrical characteristics of the panel to shift or focus a microwave beam passing through the panel. The additional pairs of conductive leads also operate as microwave elements to increase the bandwidth of the panel.

23 Claims, 5 Drawing Figures

ELECTRONICALLY CONTROLLED DIELECTRIC PANEL LENS

BACKGROUND OF THE INVENTION

The present invention relates to an electronically controlled microwave dielectric panel lens having improved bandwidth and reduced biasing requirements.

As illustrated by U.S. Pat. No. 3,708,796 issued to M. Gilbert Bony electronic scanning lens are known which are made up of one or more dielectric panels positioned one behind the other in parallel planes perpendicular to the direction of propagation of an incident electromagnetic microwave. Each panel of such lens is constructed of dielectric material in which are mounted a plurality of conductors or leads such as metal wires. Preferably the incident microwave has a fixed linear polarization and metal wires are embedded in the dielectric panels parallel to the electronic field component of the linear polarized incident microwave.

In accordance with the teachings of Bony, a plurality of diodes are spaced apart on each wire in series combination. The diodes of each wire are all aligned in the same direction of forward conduction or polarity and thus, application of a forward bias to the external ends of each wire results in that wire being made continuous whereas application of a reverse bias to the exterior ends of each wire results in that wire being rendered electrically discontinuous at the points where the diodes are located.

Depending upon the distance between diodes and the state of the wires, continuous or discontinuous, different phase shift values can be obtained for that part of an incident microwave which, on passing through the dielectric panels, encounters the wires.

By selectively controlling the state of the diodes in the various wires of dielectric panels making up a lens, the phase of the transmitted microwave can be made to vary, which results in a controlled deflection of the microwave beam passing through the lens.

The simplicity of such electronically controlled microwave lens, especially when used as an electronic scanner, represents a significant technological advance over conventional phase array systems. The simplicity of the panel lens is achieved since the wires mounted in the dielectric panels simultaneously fulfill two functions: the function of commanding the diodes and the function of acting as microwave components. Thus, the command of the diodes is not adversely affected by supplemental leads which constitute obstacles to microwave energy attempting to cross the dielectric panels of the lens. However, such panel lens have limited bandwidth and matching capabilities.

Furthermore, to achieve the simplicity of such electronic lens, all the diodes of each wire are required to be positioned in the same direction of forward conduction or polarity, so that forward and reverse biasing of each wire will result in a continuous wire, or discontinuous wire, respectively. However, it is desirable that a substantially higher voltage be employed to reverse bias the diodes than to forward bias the diodes. Thus, substantially greater voltage is required to render the wires discontinuous than to make them continuous. In fact, in large panel lens with high diode densities, for example, wherein two hundred or more diodes are employed in series for each wire, the required reverse bias for each wire becomes extremely high. In the above example, a reverse bias requirement of 50 volts for each diode results in an overall required reverse bias voltage of ten thousand volts.

These large voltages necessitate heavy insulation between different wires in the same panel and between wires of adjacent panels when a plurality of panels are employed one behind the other. Furthermore, these large voltages necessitate having heavy insulation between supply leads external to each panel and these large voltages create difficulties in building a system for applying large voltages to particular wires in small on/off switching times, for example, on the order of 10 microseconds, as is required in an electronically controlled dielectric panel lens.

Thus, the technique of biasing diodes by employing the same wire on which they are mounted as a biasing connection is useful when the number of diodes per wire is limited or when the reverse biasing voltage required to be applied to the diodes to render the wire discontinuous is small. However, such a technique is cumbersome when the number of diodes placed in series on a wire is large or when the required individual reverse bias voltage of each diode is large.

It is therefore an object of the present invention to increase the bandwidth of electronically controlled dielectric panel lens and to provide an electronically controlled panel lens of reduced biasing requirements.

Another object of the present invention is to provide a modification to the biasing arrangement of prior art electronically controlled panel lens permitting a reduction of the required reverse bias voltage while maintaining or improving the bandwidth of the panel lens and further while maintaining or improving the phase shift selectivity of the panel lens.

Additional objects and advantages of the invention will be set forth in part in the description which follows and, in part, will be obvious from the description or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, the present invention is an improvement in a prior art lens apparatus for phase shifting a wave transmitted by a microwave radiating source which prior apparatus comprises at least one dielectric panel including first conductive leads preferably located in planes parallel to the electric field vector of the wave, and which dielectric panel further includes a plurality of switch means, having conductive and non-conductive states, mounted on the first leads with each switch means spaced apart on the first conductive leads one from another by a distance which enables shifting the phase of the transmitted wave by selectively controlling the conductive state of the switch means, the improvement in this prior art lens apparatus comprising: (a) the dielectric panel having second conductive leads adjacent to and parallel with the first leads; (b) the switch means of each first lead being divided at junctions into groups, the switch means of each group being connected in the same polar direction thereby defining a polarity for each group and successive groups of each first lead being of alternate polarity; and (c) means for coupling the groups of each first lead in parallel between two second leads with the polarity of each parallel-connected group being in the same direction whereby selective biasing of each two second leads assures each respective first lead being selectively rendered continuous and discontinuous by the bipolar switch means.

In the preferred embodiment of the present invention, each two second leads are placed one on each side of a first lead and each of the groups of switches on the first leads comprise the same number of switch means.

In the preferred embodiment of the present invention, there are included conducting strands lying normal to the first and second conducting leads coupling alternate junctions on the first leads to one of the two second leads and junctions between these alternate junctions to the other of the two second leads.

In the preferred embodiment of the present invention, each switch means is spaced apart on the first conductive leads one from the other by a distance which enables the portions of the first leads between the switch means to operate as capacitive elements when the switch means are in a non-conductive state and the second leads are preferably spaced apart from the first leads a select distance which improves matching of the lens apparatus to the incident microwave.

BRIEF DESCRIPTION OF THE DRAWINGS

The accompanying drawings, which are incorporated in and constitute a part of this Specification, illustrate a preferred embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Broadly, lens apparatus for phase shifting a wave transmitted by a microwave radiating source are known to comprise at least one dielectric panel. The dielectric panels of lens apparatus include first conductive leads and a plurality of switch means having conductive and nonconductive states mounted on said first conductive leads. The switch means are conventionally spaced apart on said first conductive leads one from another by a distance which enables the portions of said first leads between said switch means to operate as capacitive or inductive microwave elements when said switch means are in a non-conducting state.

Figure 1:
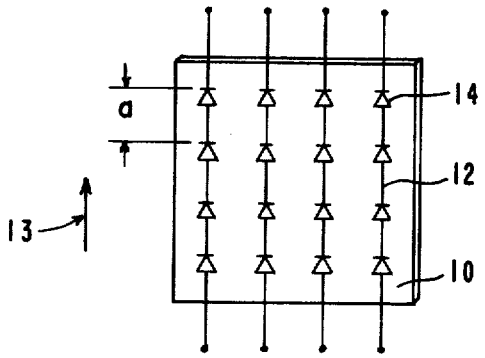
FIG. 1 is a diagrammatic illustration of a prior art electronically controlled dielectric panel lens.

Referring to FIG. 1, there is shown a simple diagrammatic illustration of one such lens apparatus taught in U.S. Pat. No. 3,708,796 issued to M. Gilbert Bony for focusing or phase shifting a wave transmitted by a microwave radiating source. The specific example of a lens apparatus shown in FIG. 1 comprises one dielectric panel 10 although a plurality of dielectric panels may be employed to make up a dielectric panel assembly as is taught, for example, in the Bony patent.

In the prior art lens apparatus illustrated in FIG. 1, dielectric panel 10 includes first conductive leads 12 mounted on, or embedded in, the panel assembly 10 in planes parallel to the electric field vector 13 of an incident transmitted microwave. Leads 12 may, for example, comprise metallic wires or other forms of suitable conductors.

In the illustrated prior art apparatus, a plurality of switch means, represented here by a plurality of diode switches 14, are mounted on each first conductive lead 12 with all diode switches 14 on each lead 12 facing in the same direction of forward conductivity and, therefore, having the same polar direction. Thus, when a sufficiently large forward biasing voltage is applied to each first conducting lead 12, all diode switches 14 mounted thereon conduct, and each first diode lead 12 appears to an incident microwave as a continuous conductor. However, when a reverse bias is placed across each first conducting lead 12 of sufficient magnitude to back bias each diode switch 14 positioned thereon, diode switches 14 effectively render each first conductive lead 12 discontinuous at intervals determined by the location of the diode switches 14.

As explained in the Bony patent, diode switches 14 may be spaced apart on first conductive leads 12 one from another by a distance "a" less than twice the wavelength, in the dielectric panel, of the radiated incident energy. As also explained in the Bony patent, diode switches 14 are preferably spaced apart on first conductive leads 12 one from another by a distance "a" close enough to enable the portions of first conductive leads 12 between diode switches 14 to operate as capacative elements when first conductive leads 12 are rendered discontinuous by a back, or reverse, biasing of diode switches 14.

As is well known in the antenna art, when the length of an elongated passive element is less than $\frac{1}{2}\lambda$ where $\lambda$ is the wave length of an incident wave, the element acts as a capacitive element. However, when the length of a passive element is $\frac{1}{2}\lambda$ the element is resonant and when the length of a passive element is greater than $\frac{1}{2}\lambda$ the element acts as an inductive element.

Figure 2:
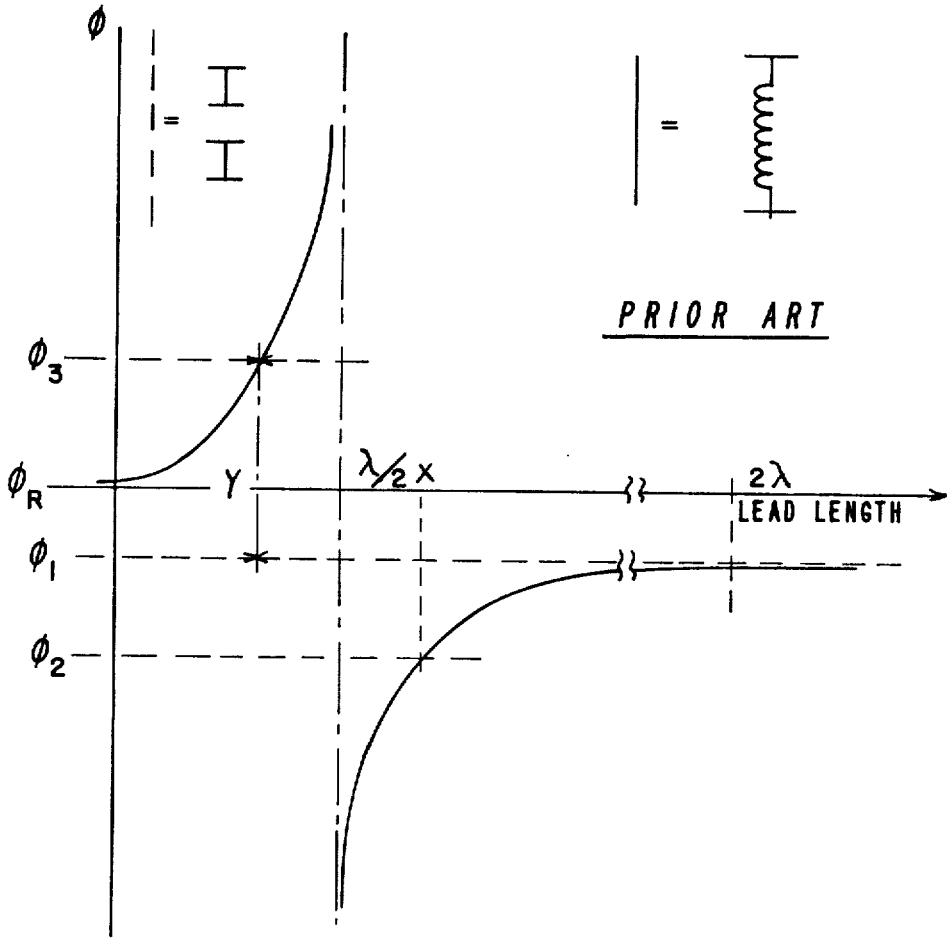
PRIOR ART FIG. 2
FIG. 2 is a diagram illustrating the operation of the electronically controlled dielectric panel lens of FIG. 1.

FIG. 2 illustrates the application of these well known facts to the Bony device shown in FIG. 1. When diode switches 14 are forward biased and first conductive leads 12 are rendered continuous, the lens apparatus effects a phase shift on an incident wave from the wave's free-space reference phase of $\phi_R$ to a new phase $\phi_1$. When diode switches 14 are reversed biased and first conductive leads 12 are rendered discontinuous, the lens apparatus effects a phase shift on the incident wave from reference phase $\phi_R$ to a new phase which depends, inter alia, on the interdiode switch distance "a". For example, when distance "a" is choosen to be a distance X greater than $\lambda/2$ and less than $2\lambda$, the wave assumes a new phase $\phi 2$. Consequently the apparatus of FIG. 1 allows for a controlled phase shift of an incident microwave of $\Delta\phi$ where $\Delta\phi$ equals $\phi_2-\phi_1$.

When distance "a" is chosen to be a distance less than $\lambda/2$, the incident wave assumes a new phase $\phi_3$ upon passing through panel 10 when diode switches 14 are backed biased. In this case, the apparatus of FIG. 2 allows for a controlled phase shift of an incident wave of $\Delta\phi$ where $\Delta\phi$ equal $\phi_3-\phi_1$. As should be obvious to anyone skilled in the art, distance "a" should never be choosen to be exactly $\lambda/2$. Therefore, by selectively controlling the forward and reverse biasing of the diode switches, such a panel or panel assembly can electronically focus or scan an incident microwave.

Preferably, dielectric panel 10 is designed to prevent reflection of an incident microwave independent of the state of diode switches 14. One way to minimize reflection of the incident wave, as is taught by the Bony patent, is to construct panel 10 from a dielectric sheet whose width is one half the wavelength of the incident wave within the dielectric panel, or a multiple thereof. An alternative way to minimize reflections when a plurality of panels 10 make up a dielectric panel assembly is to space apart one panel 10 from others in such a way that the reflections arising from each panel 10 combine in amplitude and relative phase such that no resultant reflective wave is produced. This result may be achieved, as pointed out in U.S. Pat. No. 3,708,796, by using the so-called "sandwich technique" of the prior art. In either case, when diode switches 14 are spaced at a distance "a" less than $\lambda/2$ and reversed biased the capacitive effect of first conductive leads 12 results in some unbalanced capacitance which limits the bandwidth and matching capabilities of the lens apparatus.

The prior art lens apparatus, as generally illustrated in FIG. 1. is useful when the number of diode switches 14 per lead 12 is limited or when the required reverse-biasing voltage of diode switches 14 is relatively small. However, prior art techniques, as generally illustrated in FIG. 1, are rendered cumbersome and difficult to implement when the number of diode switches 14 in series on each first conductive lead 12 is large and when the required individual reverse bias voltage of each diode switch 14 is large. For example, in large lens apparatus, it may be desirable to employ as many as two hundred diode switches 14 each having a reverse bias on the order of 50 volts which would result in a required reverse bias of 10 thousand volts. This necessitates large power supplies and heavy insulation.

To avoid the high reverse biasing requirements of the prior art devices and to improve the matching and bandwidth capabilities of the prior art devices, the present invention improves the manner by which biasing is supplied to diode switches 14 on first conductive leads 12 to selectively assure leads 12 are either continuous or discontinuous in accordance with the state of diode switches 14 while still allowing first conductive leads 12 with diode switches 14 mounted thereon to encompass a part of a network of leads forming an effective phase-shifting lens apparatus.

The improved lens apparatus of the present invention, as applied to the prior art device illustrated in FIG. 1, further provides supply bias voltage to diode switches 14 without introducing any extraneous additional control leads which adversely affect the operation of panel 10. The present invention also allows simultaneous biasing of all diode switches 14 on a first conductive lead 12, does not require the high reverse bias voltages which are troublesome to the prior art, and results in increasing the bandwidth of panel 10 as well as increasing the control of the differential phase shift between the continuous and discontinuous states of first leads 12 in panel 10.

Figure 3:
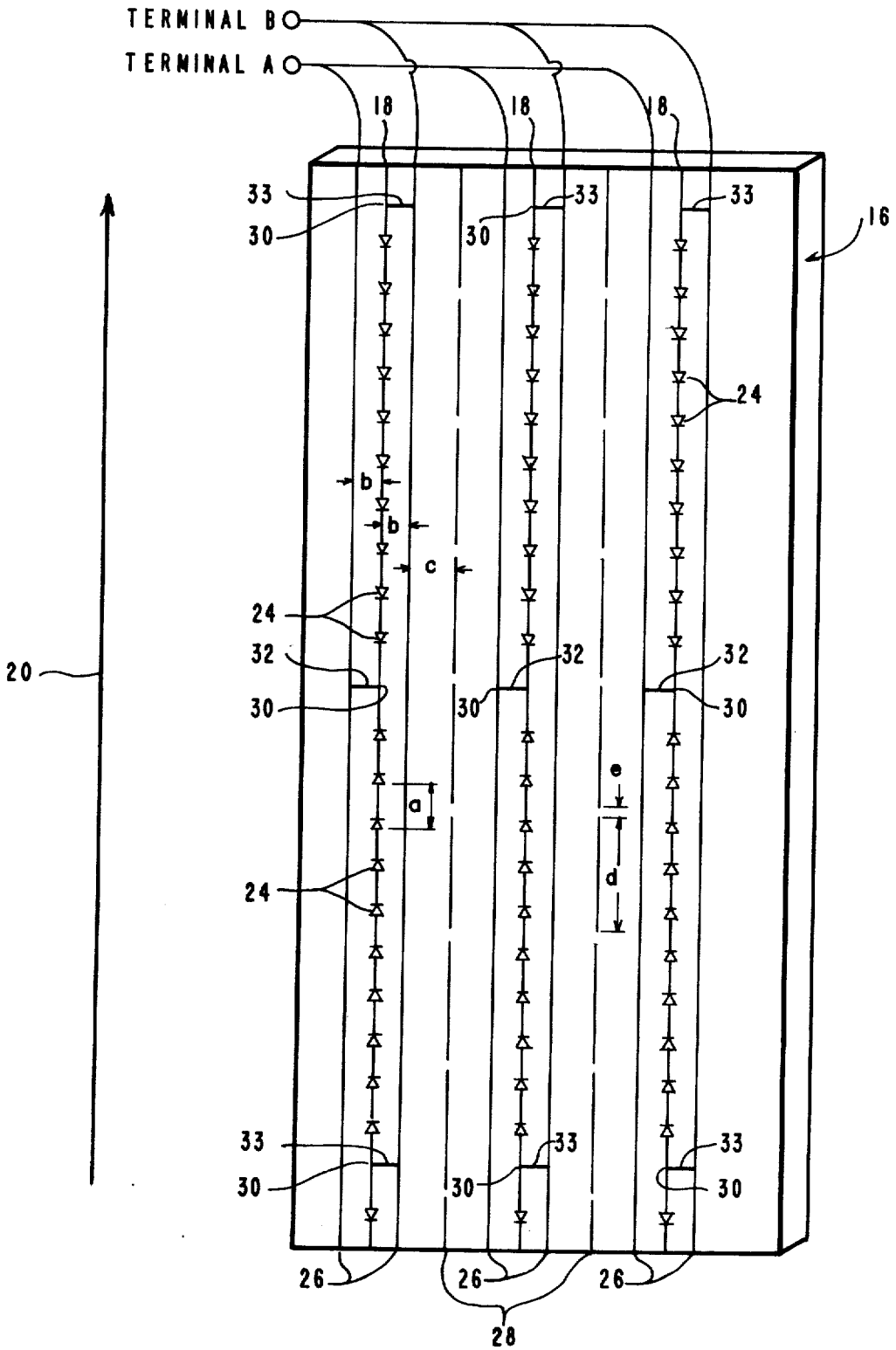
FIG. 3 is a diagrammatic illustration of one example of the preferred embodiment of the improved electronically controlled dielectric panel lens constructed in accordance with the teachings of the present invention.

Referring to FIG. 3, there is illustrated an improved lens apparatus incorporating the teachings of the present invention.

In accordance with the present invention, the improvement is provided in a prior art lens apparatus for shifting a wave transmitted by a microwave radiating source having at least one dielectric panel including first conductive leads and a plurality of switch means having conductive and nonconductive states mounted on said first conductive leads. For example, a lens apparatus is shown in FIG. 2 comprising at least one dielectric panel 16. Preferably panel 16 is designed as taught in the prior art to minimize reflection of incident microwaves.

Dielectric panel 16 includes a repeating pattern of first conductive wires or leads 18 in planes parallel to the electric field vector 20 of the incident microwave. A plurality of bipolar or dipole switch means are represented in FIG. 3 by diode switches 24, preferably all identical. Diode switches 24 have conductive and non-conductive states. When forward biased, diode switches 24 are conductive and when reversed biased, diode switches 24 are non-conductive. Preferably diode switches 24 are classical PIN diodes with a punch through voltage less than 50 V. However, switches such as triodes or SCRs may be used in place of diode switches 24.

In accordance with the present invention, the improvement is provided in a prior art lens apparatus which preferably further includes each switch means spaced apart on said first conductive leads one from another by a distance which enables the portions of said first leads between said switch means to operate as capacitive elements when said switch means are in a non-conductive state. As illustrated in FIG. 2, diode switches 24 are mounted on each first conductive lead 18 and each diode switch 24 is spaced apart one from another by a distance of "a". Length "a" is preferably chosen to enable the portions of first leads 18 between diode switches 24 to operate as capacitive elements when diode switches 24 are reversed biased and thus assured of being in a non-conductive state. For example, length "a" may be chosen to be less than one half the wave length of the incident microwave in the dielectric panel 16. This enables the portions of first conductive leads 18 between diode switches 24 to operate as capacative elements when diode switches 24 are reversed biased rendering first conductive leads 18 discontinuous at intervals of length "a".

In accordance with the teachings of the present invention, the improvement to the prior art lens apparatus comprises second conductive leads in said panel adjacent to and parallel with said first conductive leads. Preferably, each two of said second conductive leads are placed one on each side of one said first conductive lead.

In the embodiment of the present invention illustrated in FIG. 2, second conductive leads 26 are included in panel 16 adjacent to, and parallel with, first conductive leads 18. More specifically, each two second conductive leads 26 are placed one on each side of each first conductive lead 18.

Wires 28 are situated in dielectric panel 16, parallel to first leads 18 and second leads 26.

Second conductive leads 26 are preferably spaced apart from first conductive leads 18 a select distance "b" and wires 28 are preferably spaced apart from each repeating pattern of first and second leads 18 and 26 a select distance "c" and cut into equal sections of length "d" separated by a gap of length "e" to improve matching of the lens apparatus to the incident microwave.

Second conductive leads 26 and wires 28, if properly positioned and dimensioned, operate to offset the capacitive overall effect of the lens apparatus when diode switches 24 are interspaced at a distance less than $\lambda/2$ and reversed biased. There is an interaction or challenge between the inductive effect of second conductive leads 26 and/or wires 28 and the capacitive effect of the discontinuous first conductive leads 18. The capacitive effect can be in fact nulled by experimental setting of the distances and dimensions. Thus, when diode switches 24 are reversed biased the lens assembly is matched. To match in the state with diode switches 24 forward biased, panel 16 may, for example, be choosen to have a width one half the wavelength of the incident wave within the dielectric panel, or a multiple thereof, or the so-called "sandwich technique" may be used or some other matching technique could possibly be employed.

One example of a desirable distances "b", "c", "d" and "e" and other specific distances and dimensions for a particular lens apparatus built according to the teachings of the present invention is set out below.

The addition of second conductive leads 26 and wires 28 also has the effect of increasing the inductive effect of panel 16 when diode switches 24 are forward biased.

As it has been experimentally observed that dispersion of susceptance of the lens apparatus with change in frequency is less critical the more inductive the panel appears, providing the panel with a larger bandwidth.

In accordance with the present invention, the improvement further comprises the switch means of each first conductive lead being divided at junctions into groups, the switch means of each group being connected in the same polar direction thereby defining a polarity for each group and successive groups of each first conductive lead being of alternate polarity.

As illustrated in FIG. 3, diode switches 24 of each first conductive lead 18 are divided at junctions 30 into groups and diode switches 24 of each group are facing in the same direction of forward conduction of polar direction thereby defining the polarity of each group. Each group of switches 24 of each first conductive lead 18 is aligned with a polarity opposite the polarity of each adjacent group. More specifically, as here illustrated, the first ten diodes switches 24 of each first lead 18 form a first group and are all aligned to forward bias from top to bottom of the panel, as shown, giving the first group a positive to negative polarity. The next ten diode switches 24 of each first lead 18 form a second group and are all aligned to forward bias from bottom to top of the panel giving the second group an opposite negative polarity. Successive groups of diode switches 24 of each first lead 18 are further connected in alternate polar directions.

In a preferred embodiment of the present invention, each group comprises the same number of switch means. For example, as illustrated in FIG. 2, each group of diode switches 24 on first conductive leads 18 contains ten diode switches with all the diode switches 24 of each group being positioned in the same polarity and successive groups of diode switches 24 on each first conductive lead 18 being aligned with alternative polarities.

Also in accordance with the teachings of the present invention, means are provided for coupling said groups of each first conductive lead in parallel between two second conductive leads with the polarity of each parallel-connected group being in the same direction, whereby selective biasing of each two second conducting leads assures each respective first conductive lead being selectively rendered continuous and discontinuous by said switch means.

As here embodied, the groups of diode switches 24 of each first conductive lead 18 are coupled in parallel between two second conductive leads 26 with the polarity of each group in the parallel connection being in the same direction. To effect this coupling in the illustrated embodiment, conducting strands 32 and 33 lie normal to both first conductive leads 18 and second conductive leads 26. Conducting strands 32 couple alternative junctions 30 of each first conductive lead 18 to second conductive leads 26 lying adjacent to and to the left of each first conductive lead 18 in the orientation shown in FIG. 3. Conducting strands 33 couple junctions between the junctions coupled by strands 32 to the other of second conducting leads 26 lying adjacent and to the right of first conductive leads 18 as shown. Thus, selective biasing of second conductive leads 26 lying to the left of first leads 18 at terminal A and biasing of second conductive leads 26 lying to the right of first leads 18 at terminal B assures each respective first conductive lead 18 being selectively rendered continuous and discontinuous by diode switches 24.

In summary, in the preferred embodiment of the present invention illustrated in FIG. 3, on each first conductive lead 18 a first group of diode switches 24 is mounted and connected in series all in the same polar direction. A second group of the same number of diode switches 24 is connected in series on the same first conductive lead 18 but in the opposite polar direction to the first group. Successive groups are aligned with alternate polar directions. Conducting strands 32 are employed to connect the negative polarity end of each group of diode switches 24 to one second conductive lead 26 and the positive end of each group of diode switches 24 is coupled to another second conductive lead 26 by conductive strands 33 whereby the groups of diodes switches 24 are coupled in parallel between two second conductive leads 26. As a result, diode switches 24 of all groups in the parallel configuration lie in the same polar direction.

Each two second conductive leads 26 associated with each first conductive lead 18 serve as voltage supply leads for the groups of diode switches 24 positioned on a given conductive lead 18. Biasing of each two second leads 26 in a first direction assures each respective first lead 18 being selectively rendered continuous by reason of the forward biasing of all diode switches 24 on that first lead 18. Biasing of each two second leads 26 in an opposite second direction assures each respective first lead 18 being selectively rendered discontinuous by reason of the reverse biasing of all diode switches 24 on that first lead 18. Each group of diode switches 24 is thus driven by the voltage supplied to each two second conductive leads 26, but because the groups of diode switches 24 are connected in parallel, the required reverse bias voltage is reduced to that required to reverse bias only those diode switches 24 in a single group.

Consistent with the teachings of the present invention, the lens apparatus comprises at least one dielectric panel and may comprise more than one dielectric panel. When one, or more than one, dielectric panel is employed the resultant one, or more dielectric panels, may be referred to as a dielectric panel assembly.

In accordance with the present invention the improvement may be applied to a lens apparatus for phase shifting a wave transmitted by a microwave source comprising a dielectric panel assembly designed to prevent reflection of said wave. One example of a lens apparatus having a dielectric panel assembly and incorporating the improvement of the present invention is shown in FIG. 4.

Figure 4:
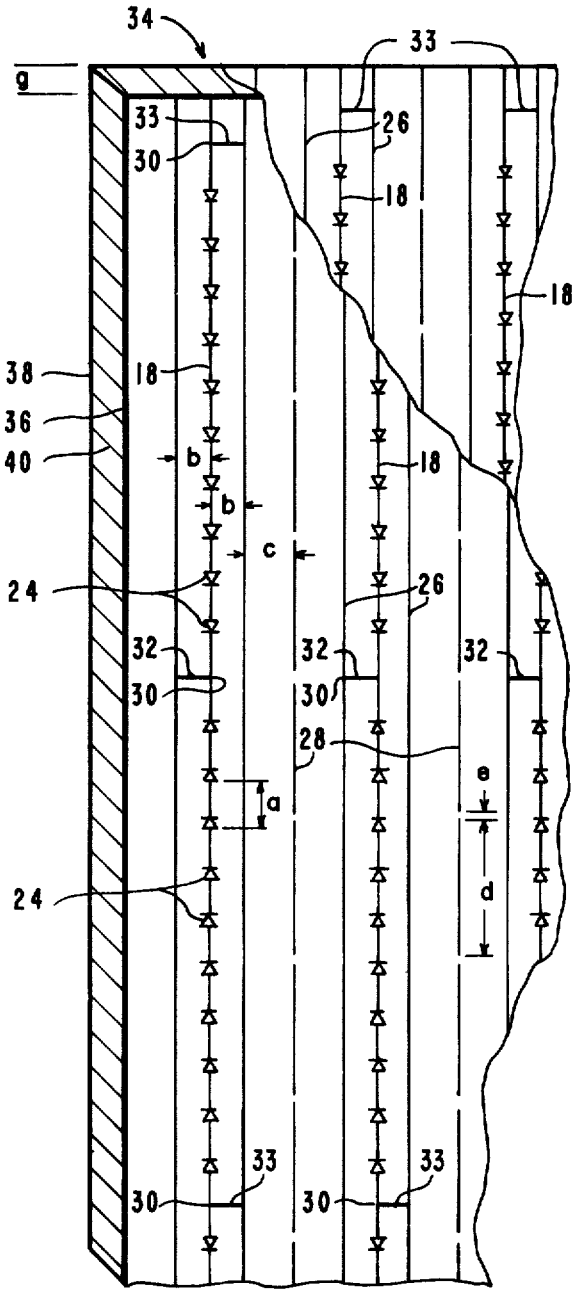
FIG. 4 is a diagrammatic illustration of another example of the preferred embodiment of the improved electronically controlled dielectric panel lens constructed in accordance with the teachings of the present invention and FIG. 5 is a diagrammatic cross-sectional view of the dielectric panel lens illustrated in FIG. 4.

In FIG. 4, a dielectric panel assembly 34 is shown to comprise a plurality of dielectric panels 36 and 38 positioned one behind the other separated by a sheet of honeycomb 40. As taught by the prior art, assembly 34 preferably is constructed with a thickness and with electrical parameters of panels 36 and 38 and honeycomb 40 chosen to prevent any substantial reflection of incident microwaves.

Networks of first conducting leads 18, diode switches 24, second conductive leads 26, wires 28, junctions 30 and conductive strands 32 and 33 in each dielectric panel 36 and 38 are essentially as described above with respect to dielectric panel 16 in FIG. 3.

Figure 5:
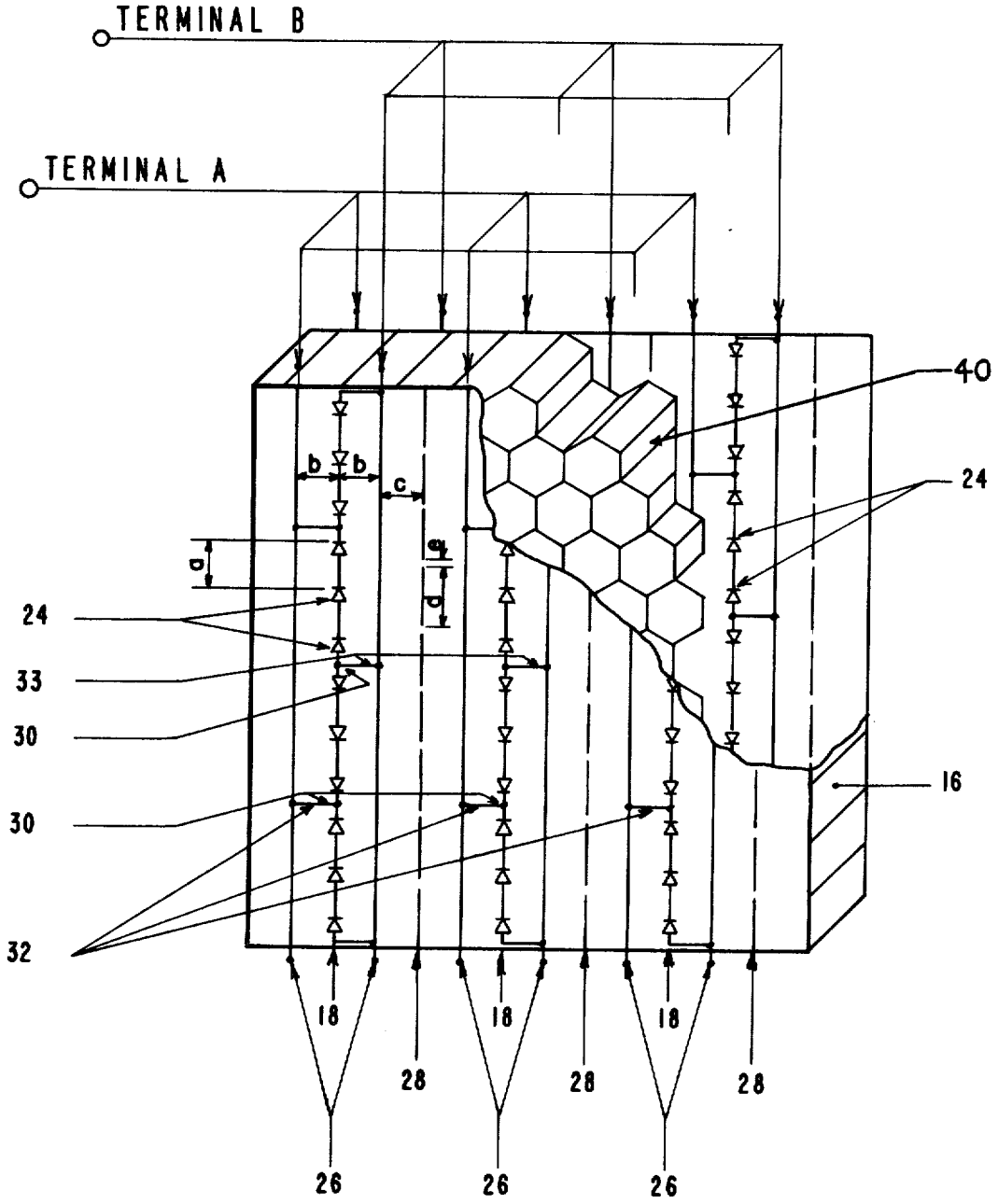

FIG. 5 is a diagrammatic cross-section view of dielectric panel assembly 34 illustrated in FIG. 4.

In the specific preferred embodiment of the present invention illustrated in FIG. 4, dielectric panel assembly 34 may, for example, have 1000×1000 mm dimensions and dielectric panels 36 and 38 may be made of reinforced polyglass sheets having a 0.5 millimeters thickness with a dielectric constant of 3.6. The panels 36 and 38 can be glued to each face of a sheet of honeycomb 40 having a thickness "g" of 22 mm and a dielectric constant equal to 1.04. First conductive leads 18 are constructed of 0.4 mm diameter wire, second conductive leads 26 of 0.22 mm diameter wire, and diode switches 24 are mounted with a constant interdiode distance "a" of 11.33 mm which is less than one half wave length (50 mm). Second conductive leads 26 are situated at a distance "b" of 8 mm on each side of each first conductive lead 18. Wire 28 is situated at a distance "c"0 of 12 mm from each of the above-described repeating pattern of first and second conductive leads 18 and 26, and wire 28 is shown cut into equal sections of length "d" equal to 30 mm and separated by gaps "e" of 0.3 mm.

In this specific embodiment of the present invention, diode switches 24 are all identical and of the PIN variety. One of the ends of each second conductive lead 26 associated with a first conductive lead 18 and the cathodes of diode switches 24 is selectively switched to a reverse biasing potential from a positive 500 volts power source while the other second conductive lead 26 associated with the same first conductive lead 18 is simultaneously grounded. The application of the 500 volts results in all diode switches 24 on the involved first lead 18 being reversed biased with an average reverse bias voltage of 50 volts and first conductive lead 18 becomes non-continuous, being cut into sections of unitary length which are defined by the interdiode distance "a".

When the biasing on second conductive leads 26 is reduced to approximately 5 volts and is reversed in polarity, all diode switches 24 on the associated first conductive lead 18 are forward biased and first conductive lead 18 will carry a continuous current of 20 ma.

The lens apparatus constructed in the above specifically described manner is matched to a 3 Ghz transmission wave. Thus, while second leads 26 act as suppliers of voltage to diode switches 24 they actually encompass a part of the network of leads forming an effective phase-shifting lens and do not adversely affect the operation of panel assembly 34.

The differential phase shift caused by the above-described panel assembly 34 between the different diodes states of forward and reverse biasing on a 3 Ghz wave polarized parallel to first and second leads 18 and 26 has been found to be 42 degrees with attenuation of less than 0.12 decibels.

The above-described improvement on the manner in which bias voltage is supplied to diode or other form of bipolar switches of a microwave lens assembly has many advantages. First, the value of the biasing voltage necessary to break the switch mounted leads into sections is drastically reduced and is only equal to the reverse bias voltage for one diode switch multiplied by the number of switches of each group. As illustrated above, this improvement makes it possible to limit the reverse biasing voltage to less than 500 volts even when as many as 200 switches, each having a reverse bias voltage of 50 volts, are employed for each switch-mounted lead. This greatly simplifies the external connections and insulation requirements outside a panel assembly to supply and control the biasing voltage.

Electrical insulation requirements on supply wires can be reduced and the external connection to a panel assembly is simplified because the reduced voltages involved allow all external connections to be grouped on the same panel side.

Furthermore, the supplemental leads for each group of switches are themselves incorporated into the panel assembly and perform not only the function of selectively biasing the switches but also the microwave function of improving matching of the panel assembly to an increased frequency band. For example, it has been found that the employment of an additional two second conductive leads 26 for each first conductive lead 18 in the specific embodiment of the present invention illustrated in FIG. 3 increases the bandwidth of a 3 Ghz lens from ±3% without additional second leads 26 to ±5% with additional second leads 26 and wires 28.

Finally, the improvement of the present invention has been found to allow better control of the value of the differential phase shift between the two states of the switches in the panel assembly due to the use of second conductive leads 26 and wires 28 with their ability to better match panel assembly 34 to the incoming microwave.

While a particular embodiment of the present invention has been shown and described, it will of course be obvious to one skilled in the art that certain advantages and modifications may be effected without departing from the spirit of the invention, and accordingly, it is intended that the scope of the invention not be determined by the foregoing examples but only by the scope of the appended claims.

What is claimed is:

1. In a lens apparatus for phase shifting a wave transmitted by a microwave radiating source having at least one dielectric panel with said at least one dielectric panel including first conductive leads and a plurality of switch means having conductive and non-conductive states mounted on said first conductive leads with each switch means spaced apart on said first conductive leads one from another by a distance which enables shifting the phase of said transmitted wave by selectively controlling the conductive state of said switch means, the improvement comprising:

a. second conductive leads in said panel adjacent to and parallel with said first conductive leads;

b. said switch means of each first conductive lead being divided at junctions into groups, the switch means of each group being connected in the same polar direction thereby defining a polarity for each group and successive groups of each first conductive lead being of alternate polarity; and c. means for coupling said groups of each first conductive lead in parallel between two second conductive leads with the polarity of each parallel connected group being in the same direction, whereby selective biasing of each two second conducting leads assures each respective first conductive lead being selectively rendered continuous and discontinuous by said switch means.

2. A lens apparatus of claim 1 wherein each two of said second conductive leads are placed one on each side of one said first conductive lead.

3. A lens apparatus of claim 2 wherein each of said groups comprise the same number of switch means.

4. A lens apparatus of claim 3 wherein said means for coupling comprises conducting strands lying normal to said first and second conductive leads and coupling alternate junctions on each of said first conductive leads to one of said two second conductive leads and further coupling junctions therebetween to the other of said two second conductive leads.

5. In a lens apparatus for phase shifting a wave transmitted by a microwave radiating source having at least one dielectric panel with said at least one dielectric panel including first conductive leads and a plurality of switch means having conductive and non-conductive states mounted on said first conductive leads with each switch means spaced apart on said first conductive leads one from another by a distance which enables the portions of said first leads between said switch means to operate as capacitive elements when said switch means are in a non-conducting state, the improvement comprising:

a. second conductive leads in said panel adjacent to and parallel with said first conductive leads;

b. said switch means of each first conductive lead being divided at junctions into groups, the switch means of each group being connected in the same polar direction thereby defining a polarity for each group and successive groups of each first conductive lead being of alternate polarity; and c. means for coupling said groups of each first conductive lead in parallel between two second conductive leads with the polarity of each parallel connected group being in the same direction, whereby selective biasing of each two second conducting leads assures each respective first conductive lead being selectively rendered continuous and discontinuous by said switch means.

6. A lens apparatus of claim 5 wherein each two of said second conductive leads are placed one on each side of one said first conductive lead.

7. A lens apparatus of claim 6 wherein each of said groups comprise the same number of switch means.

8. A lens apparatus of claim 7 wherein said means for coupling comprises conducting strands lying normal to said first and second conductive leads and coupling alternate junctions on each of said first conductive leads to one of said two second conductive leads and further coupling junctions therebetween to the other of said two second conductive leads.

9. A lens apparatus of claim 5 wherein said second conductive leads are spaced apart from said first conductive leads a selected distance to improve matching of said lens apparatus to said wave.

10. A lens apparatus of claim 9 comprising additional conductive means for further improved matching of said lens apparatus to said wave.

11. In a lens apparatus for phase shifting a wave transmitted by a microwave radiating source having a dielectric panel assembly designed to prevent reflection of said wave and including first conductive leads in planes parallel to the electric field vector of said wave, and a plurality of switches mounted in the same polar direction on each said first lead with each switch spaced apart thereon from another by a distance which enables the portion of said first leads between said switches to operate as capacitive elements when the switches are in a non-conducting state, the improvement comprising:

a. second conductive leads in said panel assembly adjacent to and parallel with said first conductive leads;

b. said switches of each first lead being divided at junctions into groups, the switches of each group being connected in the same polar direction thereby defining a polarity for each group, and each group of each first lead having an opposite polarity of each adjacent group; and c. means for parallel coupling said groups of each first lead between two of said second leads with the polarity of each parallel coupled group being in the same direction, whereby biasing of said two second leads in a first direction assures each respective first lead being selectively rendered continuous and biasing of said two second leads in an opposite second direction assures each respective first lead being selectively rendered discontinuous by said switches.

12. A lens apparatus according to claim 11 wherein each two of said second conductive leads are placed one on each side of a first conductive lead.

13. A lens apparatus according to claim 12 wherein each of said groups of switches comprise the same number of switches.

14. A lens apparatus according to claim 13 wherein said means for coupling comprises conducting strands lying normal to said first and second conductive leads and coupling alternate junctions on each said first conductive lead to one of said two second conductive leads and further coupling junctions therebetween to the other of said two second conductive leads.

15. A lens apparatus according to claim 14 wherein said second conductive leads are spaced apart from said first conductive leads a select distance which improves matching of said lens apparatus to said wave.

16. A lens apparatus according to claim 15 comprising additional conductive means for further improved matching of said lens apparatus to said wave.

17. In a lens apparatus for phase shifting a wave transmitted by a microwave radiating source having an essentially non-reflective assembly including at least two dielectric panels placed one behind the other and interposed across the path of said wave, each said dielectric panel including at least one network of first conductive leads embedded in said panel and located in planes parallel to the electric field vector of said wave and a plurality of switch means mounted on each said first conductive leads and spaced apart thereon by a distance no more than one half the wave length of said wave in said dielectric panels for allowing said first conductive leads to either be divided into sections or not divided into sections by said switch means, said switch means operated by a control voltage applied to said switch means on each first conductive lead to vary the phase of said wave, the improvement comprising:

a. second conductive leads embedded in said panel adjacent to and parallel with said first conductive leads;

b. said switch means for each first conductive lead being divided at junctions into groups, the switch means of each group being connected to define a polarity for each group and successive groups of each first conductive lead being of alternative polarity; and c. means for coupling said groups of each first conductive lead in parallel between said second conductive leads with the polarity of each group being in the same direction, whereby selective reverse biasing of each of said two second conductive leads results in said first conductive leads being selectively rendered discontinuous by said switch means.

18. A lens apparatus according to claim 17 wherein each two of said second conductive leads are placed one on each side of each of said first conductive leads.

19. A lens apparatus according to claim 17 wherein said switch means are bipolar diodes.

20. A lens apparatus according to claim 17 wherein each of said groups comprise the same number of bipolar diodes.

21. A lens apparatus according to claim 18 wherein said means for coupling comprises conducting strands lying normal to said first and second conductive leads coupling alternate junctions on each said first conductive lead to one of said each two of said second conductive leads and further coupling junctions therebetween to the other of said each two of said second conductive leads.

22. A lens apparatus according to claim 17 wherein said second conductive leads are spaced apart from said first conductive leads by a selected distance to improve matching of said lens apparatus to said wave.

23. A lens apparatus according to claim 22 comprising additional wire means located in said panel parallel to said second conductive leads at a point where the capacitive effect of said first conductive leads when divided into sections is nullified by the inductive effect of said second conductive leads and said wire means for further improved matching of said lens apparatus to said wave.

* * * * *